United States Patent [19]

Jaffe

[11] 3,934,325

[45] Jan. 27, 1976

[54] FASTENING METHOD, APPARATUS AND ARTICLE

[75] Inventor: David M. Jaffe, Guilford, Conn.

[73] Assignee: Automatic Fastener Corporation, Branford, Conn.

[22] Filed: May 10, 1974

[21] Appl. No.: 468,990

[30] Foreign Application Priority Data

May 29, 1973 United Kingdom..... 25582/73

[52] U.S. Cl. ..... 29/243.52; 72/457; 29/212 D; 29/523; 72/391

[51] Int. Cl.[2]..... B21J 15/06

[58] Field of Search..... 29/243.53, 212 D, 252, 29/523, 243.52; 72/391, 457, 461

[56] References Cited

UNITED STATES PATENTS

| | | | |
|---|---|---|---|
| 2,087,969 | 7/1937 | Gookin | 29/243.52 X |
| 2,535,403 | 12/1950 | Froggatt | 29/243.52 |
| 3,232,162 | 2/1966 | Ketchum | 29/243.52 X |
| 3,478,567 | 11/1969 | Galutia | 72/457 |
| 3,501,790 | 3/1970 | Wickers | 29/523 X |
| 3,665,581 | 5/1972 | Gulistan | 29/243.52 |
| 3,763,541 | 10/1973 | Jaffe | 29/212 D |

*Primary Examiner*—Milton S. Mehr
*Attorney, Agent, or Firm*—Barry H. Fishkin, Esq.

[57] ABSTRACT

Apparatus for setting blind fasteners, which comprises means for engaging and setting one side of a fastener and driving it in a rectilinear path, means mounted in said rectilinear path for engaging and setting the other side of the fastener and means mounted adjacent the last named means for biasing material on the fastener together prior to the setting of the other side of the fastener.

11 Claims, 20 Drawing Figures

FASTENING METHOD, APPARATUS AND ARTICLE

BACKGROUND

This invention relates to fasteners and more particularly to an improved method of an apparatus for setting blind fasteners and to improved fasteners adaptable for use with the improved method and apparatus.

Blind fasteners are utilized to fasten two pieces of material together when only one side of the work is accessible to the fastening tool.

While many different tools and methods of setting blind fasteners have been devised, the clamp-up provided to the set fastener thereby has not, in many cases, been as firm as some applications may demand. In addition, in many cases, previous methods and apparatus have provided sets where the pieces of material being fastened are not held flush against each other.

The reasons for these failures in the prior art fasteners is principally because only one side of the fastener was effectively worked by the fastening apparatus.

For example, a typical blind fastener comprises a hollow barrel portion and a flat annular flange at one end thereof. A mandrel that is similar to a headed nail is mounted in the barrel portion of each fastener with the shank of the mandrel extending out of the flange end of the fastener. The head of the mandrel protrudes out the barrel portion of the fastener. The fastener is set by pulling the mandrel shank with an appropriate tool, such as that shown in U.S. Pat. No. 3,164,283, so that the head of the mandrel deforms the far side of the fastener and thus captures the pieces of material to be set between the deformed far side of the fastener barrel portion and the fastener flange.

However, with this arrangement, the setting action of the mandrel is limited by the strength of the barrel portion material and the pulling force exerted by the fastener tool. In many instances, the pulling force is not strong enough to force the upset material back into the rear of the work so as to tightly clamp the material between the upset part of the barrel portion and the fastener flange.

Another problem encountered with this arrangement is that if the pieces of material to be set were not held together prior to the setting operation, the initial upsetting of the far end of the fastener would "freeze" the front piece of material on the fastener barrel portion adjacent the upset. At this point, there was no way to bring the pieces of material together on the fastener. Thus, the rear pieces of material were movable laterally on the fastener between the frozen piece and the flange. This was obviously undesirable.

Attempts to improve the set of a fastener by performing operations on both sides thereof, such as that disclosed in U.S. Pat. No. 2,477,056, were not satisfactory in that the rear setting operation was weak and no operation was performed to bring the pieces of material to be set together before the final setting operation was completed.

The inventor of the method, apparatus and fasteners described herein has previously devised the improved fastening apparatus disclosed in U.S. Pat. No. 3,763,541, which provided a substantially stronger set than those provided theretofore and, in addition, removed the necessity of providing a mandrel with each fastener, a significant cost saving. However, even with the substantially stronger setting force, there were instances when the pieces of material being set were not clamped together and set in that position, particularly when the first piece of material was "frozen" by the initial setting action.

SUMMARY

It is, therefore, an object of this invention to provide an improved method of setting blind fasteners.

It is another object of this invention to provide a fastener setting system wherein an efficient setting operation is performed on both sides of a fastener.

It is another object of this invention to provide a fastener setting system wherein the material being fastened is handled during the setting operation to enhance the performance of the setting process.

It is still another object of this invention to provide a sequential setting process for blind fasteners wherein the material is biased together before the final setting step is performed and the material is clamped into position.

It is a more specific object of this invention to provide an improved apparatus for setting blind fasteners.

It is a still more specific object of this invention to provide an apparatus for setting blind fasteners including independent means for sequentially upsetting each side of the fastener and for urging the material to be fastened together prior to the completion of the last upsetting step.

It is a further object of this invention to provide improved fasteners for use with the improved method of and apparatus for setting blind fasteners.

In accordance with these and other objects, apparatus according to the invention may comprise a means for sequentially setting one side of a blind fastener, biasing the material to be fastened together and then setting the other side of the fastener to clamp the material together.

DESCRIPTION OF THE PREFERRED EMBODIMENTS

Figure 1:
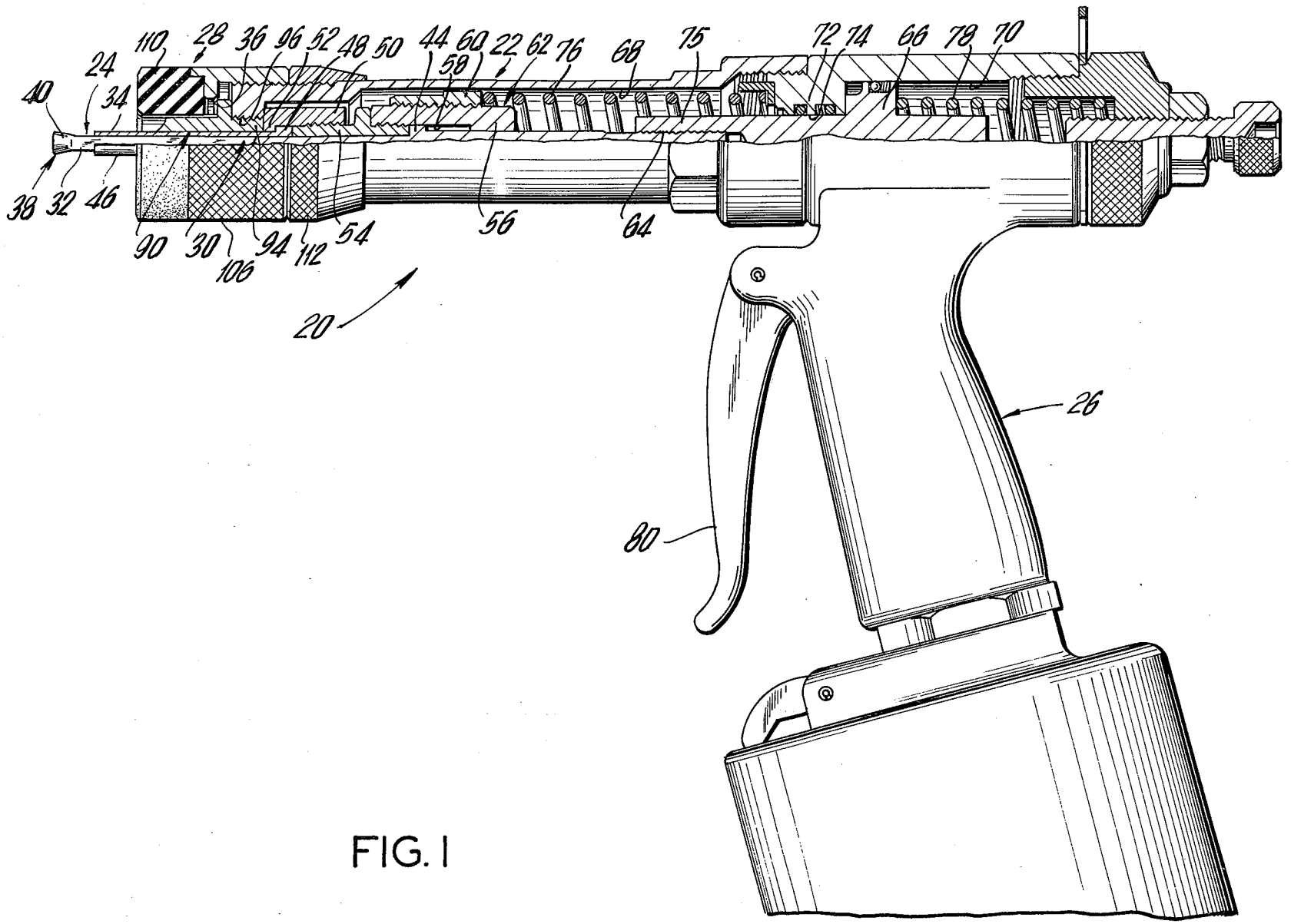
FIG. 1 is a side elevation view of a hand tool embodying the principles of the invention, with portions thereof partially in section.

With reference to the drawings, a preferred embodiment of apparatus according to the invention comprises a fastening tool 20 including a housing 22, a front fastener setting assembly 24 that is reciprocal with respect to the housing 22 by a pneumatic-hydraulic assembly 26, and a rear fastener setting assembly 28.

The front fastener setting assembly 24 performs the function of upsetting the front, or barrel, end of the fastener. One embodiment of apparatus for performing this function is depicted in FIG. 1 and is similar to that more fully described in U.S. Pat. No. 3,763,541 issued to the same inventor as the apparatus disclosed. With reference to FIG. 1, the front fastener setting assembly 24 comprises an expandible mandrel assembly 30 mounted for reciprocal movement in housing 20 and including a center mandrel 32 and a sleeve 34 mounted about the front of the center mandrel.

The mandrel assembly is positioned and dimensioned such that a substantial portion thereof extends out of the housing 22 through an aperture 36 provided therein, as seen in FIG. 1. The portion of the mandrel assembly that extends out of housing 22 is long enough to permit a fastener having an aperture therein to be placed thereon.

The front end 38 of center mandrel 32 is enlarged by a diverging frustoconical portion 40. A collar 44 is mounted on the center mandrel 32 substantially to the rear of the front end thereof and is positioned within the housing 22 for a purpose made clear hereinabove. The sleeve 34 comprises a plurality of fingers 46 that have a mounting flange 48 at the rear thereof.

The collar 50 having a locking flange 52 is threadedly mounted on a sleeve 54 mounted around center mandrel 32. A member 56 is threadedly mounted on sleeve 54 and forms an expansion cylinder 58 therewith. The expansion cylinder 58 encloses collar 44, as clearly shown in FIG. 1.

A sliding collar 60 is threadedly mounted on expansion cylinder 58 and engages the interior wall of housing 22. The collar 60 and the expansion cylinder 58 form an assembly 62 that is slidable with respect to the interior wall of housing 22. Of course, locking flange 52 will transmit the reciprocal movement of the assembly 62 to the fingers 46.

The center mandrel 32 is connected, through a threaded connection 64, to a piston 66, which is operatively connected to the pneumatic-hydraulic assembly 26. The pneumatic-hydraulic assembly is conventional and is described in detail in the said U.S. Pat. No. 3,753,541. The arrangement of having collar 44, formed on center mandrel 32 movable in expansion cylinder 58, connected to fingers 46, provides that the fingers 34 are movable along with center mandrel 32 when collar 44 engages either the front or rear wall of cylinder 58 and are movable with respect to the center mandrel 32 during the initial portions of either a forward or reverse stroke of the center mandrel 32 a distance equal to the travel of collar 44 within the expansion cylinder 58.

The housing 22 is divided into two cylinders, 68 and 70, by a wall 72. The wall 72 has an aperture 74 therein to permit an extension 75 of piston 66 to reciprocate therein. A spring 76 is mounted between the rear of expansion cylinder 58 and the wall 72 and a spring 78 is mounted between the rear of piston 66 and the rear of housing 20. Spring 78 biases the center mandrel in its forward position, shown in FIG. 1, and spring 76 biases expansion cylinder 58 on its forward position, also shown in FIG. 1.

Upon the actuation of the pneumatic-hydraulic assembly 26 by the pressing of trigger 80, center mandrel 32 will be driven rearwardly by piston 66. In the first portion of the stroke of piston 66, the center mandrel 32 will move rearwardly with respect to fingers 46, the distance of the stroke of collar 44 in expansion cylinder 58. The effect of this movement is to make the front of the fingers 46 ride up on frustoconical portion 40 to increase the effective diameter of the mandrel assembly at this point such that it will not pass freely through the hole in the fastener.

When the collar 44 strikes the rear wall of expansion cylinder 58, further rearward motion of piston 66 causes the expansion cylinder 58 and thus the fingers 46 to be driven rearwardly along with the center mandrel. The thus expanded mandrel assembly will be operable to engage and set the front of the fastener mounted thereon and drive it toward the front of housing 22.

A plurality of configurations of center mandrels and fingers are disclosed in the aforementioned U.S. Pat. No. 3,763,541. For the purposes of the instant invention, it need only be stated that a mandrel assembly having a portion with a cross-sectional area greater than that of the aperture in the fastener engages the front of a fastener mounted thereon, distends it, and drives it to the rear.

An alternative arrangement of a front fastener setting assembly is disclosed in the aforementioned U.S. Pat. No. 3,164,283, wherein an actuating assembly causes a plurality of jaws to grasp the mandrel provided in the type of fastener that includes the same and pull the mandrel to the rear to upset the front of the fastener barrel portion. The apparatus also includes means for severing the portion of the mandrel extending from the set rivet and discarding it. For the purposes of the instant invention the front fastener setting assembly of the alternate arrangement includes the mandrel provided in the fastener and the means for grasping the mandrel and pulling it to the rear in order to set the front of the fastener.

Figure 15:
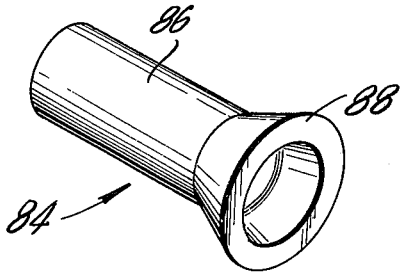
FIG. 15 is a perspective view of a new fastener, usable with the apparatus shown in FIGS. 1–9.
Figure 16:
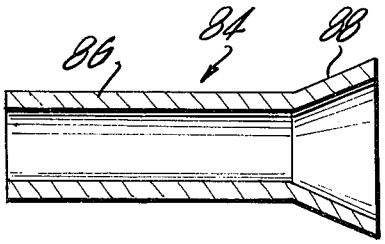
FIG. 16 is a sectional view of the fastener shown in FIG. 15.

With reference to FIGS. 15 and 16, a preferred embodiment of a fastener 84 adapted for use with the instant apparatus includes a hollow, tubular barrel portion 86 and a diverging, funnel-type rear flange portion 88.

Figure 2:
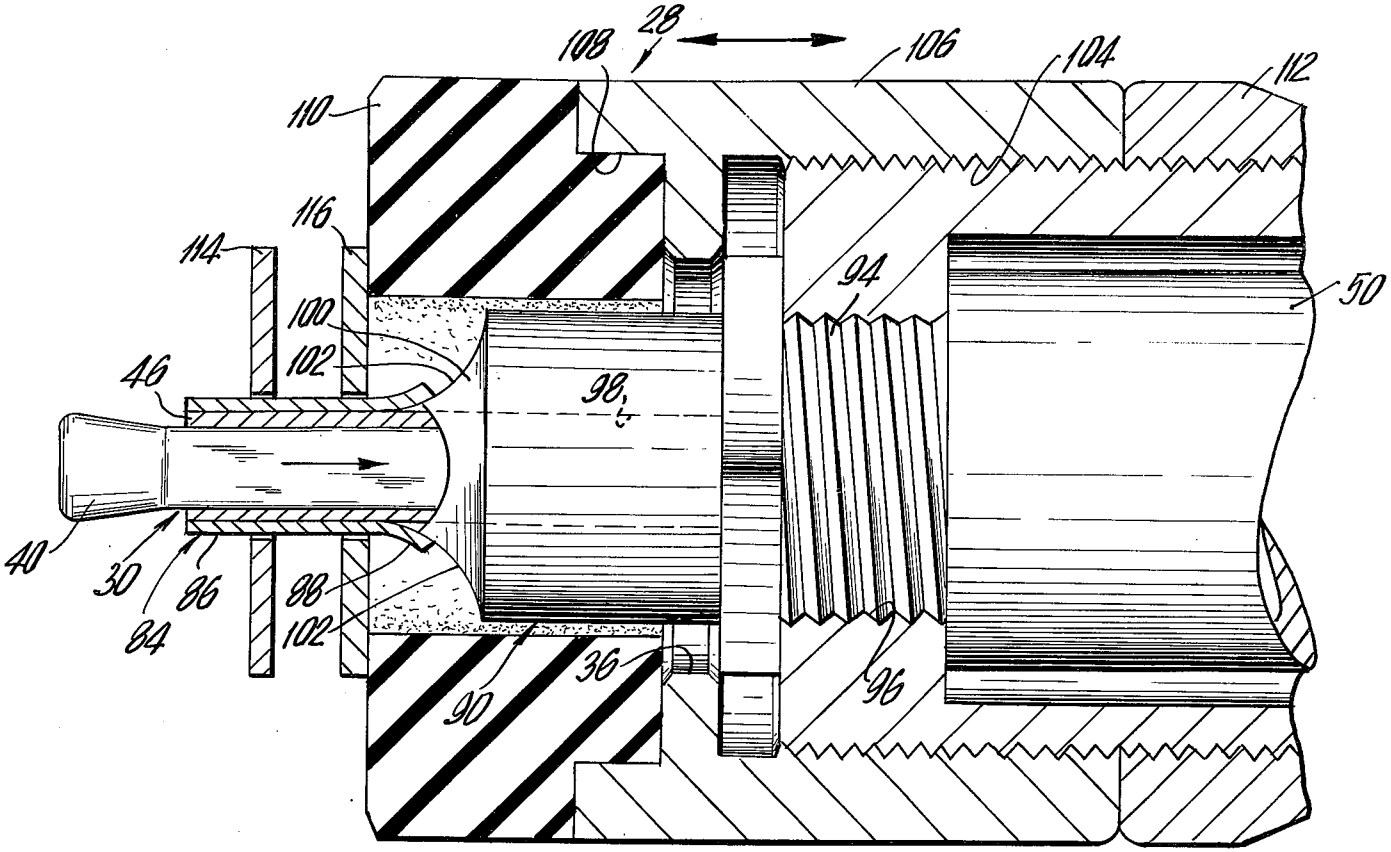
FIG. 2 is a close-up view of the front portion of the tool shown in FIG. 1.

With reference to FIG. 2, a preferred embodiment of the rear fastener setting assembly 28 includes a nosepiece 90 threadedly mounted in the front of housing 22. The nosepiece 90 is adopted to engage the rear of a fastener 84 mounted on the mandrel assembly 30, the front of which has been distended by the front fastener setting assembly 26. The expanded mandrel assembly 30 firmly engages the fastener at this stage of the operation and is driving it against the nospiece 90.

The nosepiece 90 includes a threaded mounting portion 94 that is adapted to be received in a threaded aperture 96 provided in the front of housing 22. An aperture 98 is provided through the nosepiece to accommodate mandrel assembly 30. The diameter of aperture 98 is such that the nosepiece may be unscrewed from threaded aperture 96 in the housing and removed from the apparatus by sliding it off the front of the mandrel assembly 30. The front of the nosepiece is provided with a contoured sloping face portion 100 which includes a plurality of sharp ridges 102 formed thereon. The slope of the face portion 100 is designed so as to mate with the rear of a fastener mounted on the mandrel assembly 30. In the case of fastener 84, the diverging angle of the funnel shapped flange 88 of the fastener 84, is selected to exactly mate with the front of the face portion 100 of the nosepiece 90.

Housing 22 is provided with a threaded front portion 104. A collar 106 is threadedly mounted on threaded portion 104 and is movable with respect to the exterior of the housing 22 by the rotation thereof. The front of collar 106 is provided with a recess 108. A resilient biasing member 110 is mounted in the recess 108 in collar 106 for a purpose made clear hereinbelow.

The resilient member may be fabricated out of rubber, a resilient plastic, or even out of a metallic spring. A locking nut 112 is mounted on the threaded portion 104 of housing 22 immediately to the rear of collar 106, and is operable to fix the collar 106 in position on the housing 22.

Figure 3:
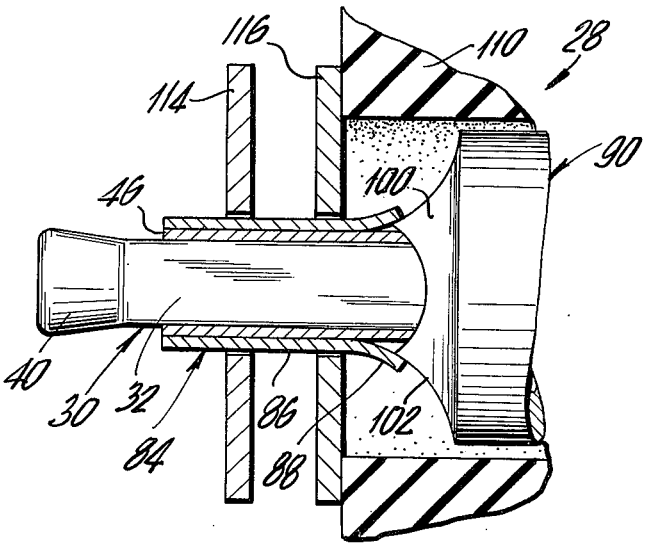
FIGS. 3–8 show, in sequence, the setting of a fastener by the apparatus shown in FIGS. 1 and 2.

With reference to FIG. 3, two pieces of material, 114 and 116, are shown on fastener 84, are spaced apart thereon, and are to be set by the instant method and apparatus flush against each other and tightly clamped together.

Figure 4:
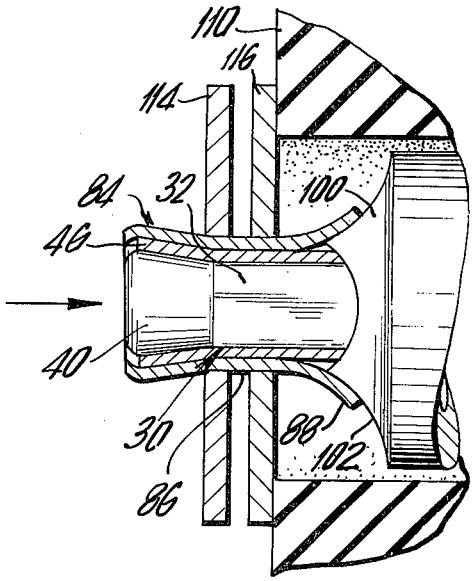

With reference to FIG. 4, the initial portion of the stroke of the pneumatic-hydraulic assembly has caused the expansion of the front of mandrel assembly 30 and the setting of the front of fastener 84. This has caused the piece of material 114 to be frozen in place on the fastener barrel portion 86. The continued rearward movement of the mandrel assembly will cause the fastener with the piece of material frozen thereon to be moved to the rear against the nosepiece 90. This forces the flange 88 of the fastener 84 against the face portion 100 of the nosepiece 90 and causes the flange of the fastener to begin to be slit by the sharp ridges 102 on the face portion 100.

Simultaneously, as the fastener 84 is driven rearwardly by the mandrel assembly 30, the resilient member 110 will push the rear piece of material on the fastener towards the front piece of material, which had been frozen in place. This action of the resilient member 110 precludes the rear piece of material on the fastener from being frozen in place by the distending and slitting of the flange of the fastener by the ridges 102 on nosepiece 100 face portion.

Figure 5:
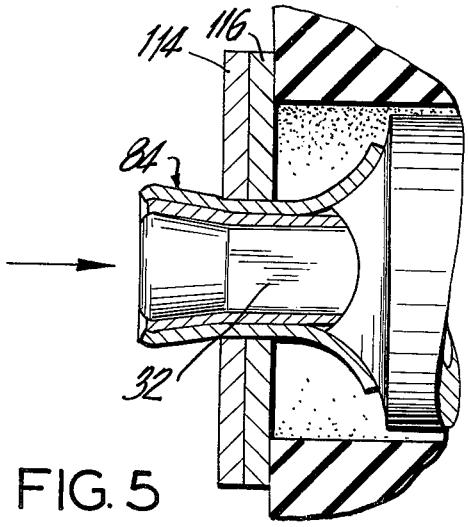

The action of the rear fastener setting assembly 28 is shown in sequence of FIGS. 3–8. It will be seen that as the flange portion is forced back upon the ridge 102 on face portion nosepiece 100 there is progressive slitting of the material of the flange portion of the fastener and a bending and curving outwardly of the slit portions of the flange (FIGS. 4 and 5).

Figure 6:
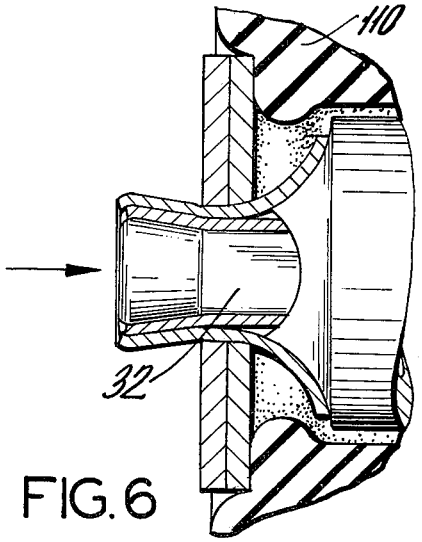

FIGS. 3—5 show the action of the resilient member 110 in biasing the rear piece of material 116 towards the front piece of material 114 in advance of the slitting of the flange of the fastener. FIG. 6 shows the final steps in the setting operation, wherein the two pieces of material, brought together by the action of resilient member 110, are forced into the resilient member 110, deforming it, to firmly hold them together as the fastener flange is slit further by nosepiece 90 and the slit portions thereof are bent outwardly and back towards the pieces of material to cause the portion of the fastener immediately to the rear of the rear piece of material to be distended and thus clamp the rear piece of material together with the front piece of material.

Figure 7:
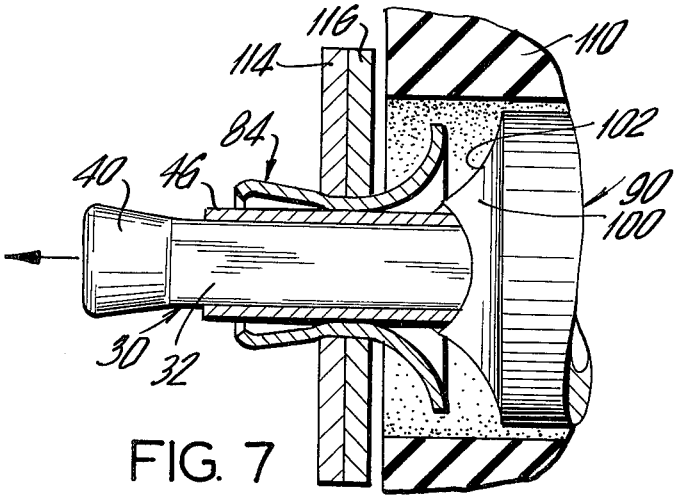
Figure 8:
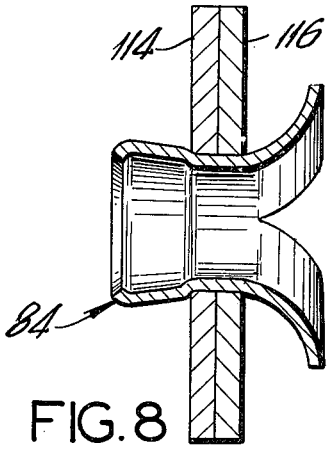
Figure 9:
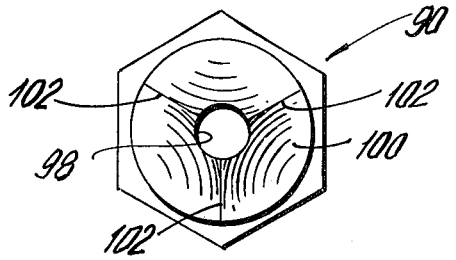
FIG. 9 is a front elevation view of a nosepiece for the apparatus shown in FIG. 2.

At this stage of the process the trigger 80 of the pneumatic-hydraulic assembly 26 is released and the forces of springs 76 and 78 cause the mandrel assembly 30 to be unexpanded and driven forwardly. This step in the process is depicted in FIG. 7. The unexpansion of the mandrel assembly permits the set fastener to be removed therefrom, as is more fully described in the aforesaid U.S. Pat. No. 3,763,541, the thus set fastener 84 being shown in FIG. 8.

Several alternative embodiments of nosepiece 90 are adaptable for use in rear fastener setting assembly 28.

Figure 10A:
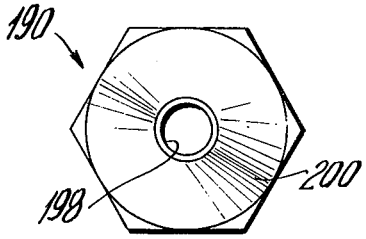
FIGS. 10*a* and 10*b* show one alternative embodiment of a nosepiece for apparatus according to the invention.
Figure 10B:
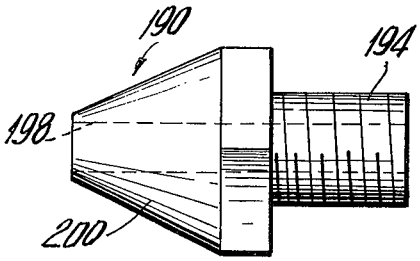
Figure 17:
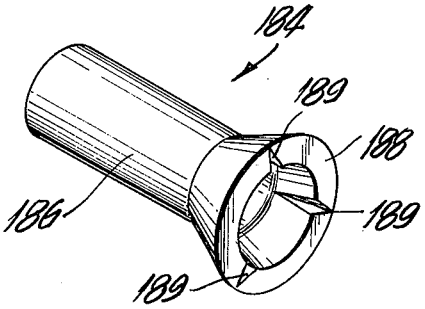
FIG. 17 is a modification of the fastener shown in FIGS. 15 and 16 and is adapted for use with the nosepiece depicted in FIGS. 10*a* and 10*b*.

With reference to FIGS. 10a, 10b and 17, one such alternate embodiment comprises a nosepiece 190 having a threaded mounting portion 194 and an aperture 198 provided therethrough for mandrel assembly 30. The threaded mounting portion 194 is adapted to be received in the threaded aperture 96 provided in the housing 22. The aperture 198, like aperture 98 in nosepiece 90, is of sufficient diameter such that the nosepiece can be removed from the tool housing by unscrewing it from threaded aperture 96 and sliding it off the front of the mandrel assembly. Nosepiece 190 includes a frustoconical face portion 200 designed so as to mate with the rear of a fastener mounted on the mandrel assembly 30.

Nosepiece 190 is particularly suitable for use with the fastener depicted in FIG. 17. Referring now to that FIG., a fastener 184 suitable for use with nosepiece 190 includes a tubular barrel portion 186, a diverging funnel type rear flange portion 188 and a plurality of notches 189 provided in the flange portion 188.

With this arrangement, after the mandrel assembly 30 has set the front of the fastener 184 in the same manner as described hereinabove, in connection with fastener 84, and is driving the fastener 184 against nosepiece 190, the force fo face portion 200 against the flange portion 188 of the fastener 184 will cause the rupture of the flange portion 188 at the notches 189. The continued rearward movement of the mandrel assembly causes the segments of the flange portion 188 to peel back in a manner similar to that disclosed in connection with fastener 84 and nosepiece 90. This, in conjunction with the action of resilient biasing member 110, results in a set fastener substantially the same as that disclosed in connection with fastener 84 and the nosepiece 90, and shown in FIGS. 8 and 13.

Figure 14:
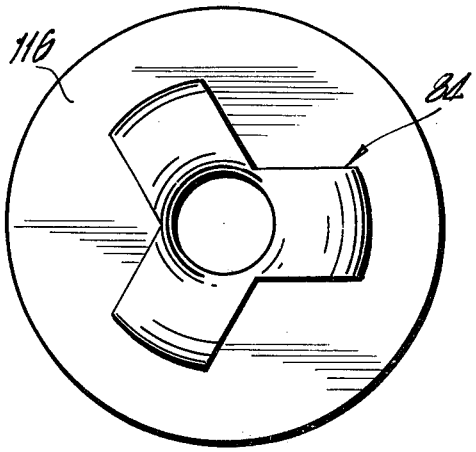
FIG. 14 depicts a fastener set by the apparatus shown in FIGS. 1–8.

In addition to the the foregoing embodiments, two additional alternate embodiments of the nosepiece 90 are provided. These two additional embodiments are shown in FIGS. 11*a* and 11*b* and 12*a* and 12*b* respectively and are operable to distend the rear of a fastener rather than causing the rear to be split or ruptured and peeled back, as described hereinabove and shown in FIGS. 8 and 14.

Figure 11A:
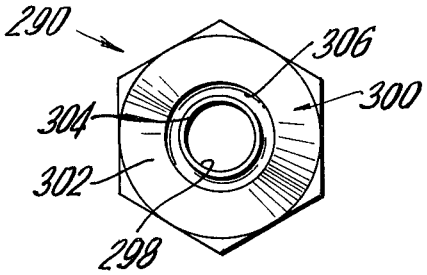
FIGS. 11*a* and 11*b* show another alternative embodiment of a nosepiece for apparatus according to the invention.
Figure 11B:
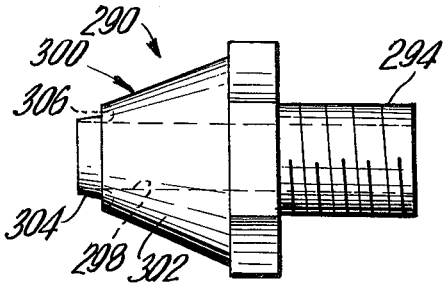

More specifically, with reference to FIGS. 11*a* and 11*b*, another embodiment of a nosepiece, designated 290, includes a threaded mounting portion 294 and an aperture 298 provided therethrough for mandrel assembly 30, said threaded mounting portion being adapted to be received in the threaded aperture 96 provided in the front of housing 22. Nosepiece 290 includes a contoured face portion 300 that includes a first frustoconical portion 302 and, provided forward thereof, a second frustoconical portion 304. The relative diameters of frustoconical portion 304 is somewhat smaller that that of frustoconical portion 302. With this arrangement, a groove 306 is formed between the two frustoconical portions, as shown in FIGS. 11*a* and 11*b*.

In operation, as the flange portion of a fastener 84 is pressed back into nosepiece 290 by mandrel assembly 30, the rear of the flange portion 88 will be pressed into groove 306, causing the flange to be rolled back towards the pieces of material being set, engaging the same and holding them together against the upset front of fastener. As in the embodiments described hereinabove, the material being set is brought together prior to clamping by resilient biasing member 110. The advantage provided by the embodiment is that the set provided to the rear of the fastener only utilizes a small portion of the fastener flange and thus the maximum diameter of the set fastener is somewhat reduced from that provided by the other embodiments.

Figure 12A:
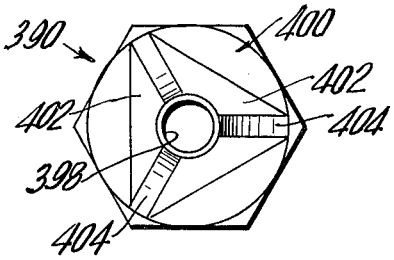
FIGS. 12*a* and 12*b* show another alternative embodiment of a nosepiece for apparatus according to the invention.
Figure 12B:
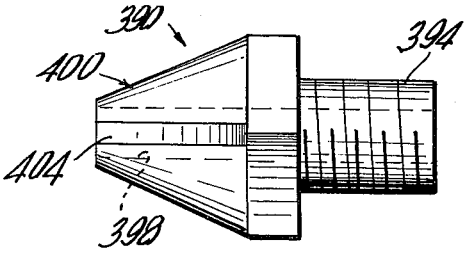

With reference to FIGS. 12*a* and 12*b*, another alternate embodiment of a nosepiece adapted for use with rear fastener setting assembly 28 is designated 390. Nosepiece 390 includes a threaded mounting portion 394 and an aperture 398 therethrough for mandrel assembly 30, the threaded mounting portion being adapted to be received in the threaded aperture 96 provided in the front of housing 22.

Nosepiece 390 includes a frustopyramid shaped face portion 400 having a plurality of flat sides 402, with a rounded edge 404 provided between each side 402. The frustopyramid face portion 400 tapers toward the front of the nosepiece. This embodiment is of particular strength and will deform the flange portion 88 with the application of less force from the mandrel assembly than the previous embodiments.

Figure 13:
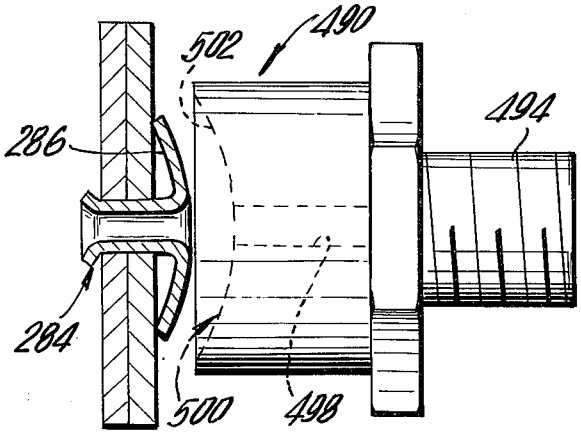
FIG. 13 shows another alternative embodiment of a nosepiece for apparatus according to the invention, which can be utilized to set another family of blind fasteners.

An additional embodiment of a nosepiece for use in rear fastener setting assembly 28 is disclosed in FIG. 13. This embodiment of the nosepiece, designated 490, includes a threaded mounting portion 494 adapted to be received in the threaded aperture 96 in housing 22 and an aperture 498 therethrough for mandrel assembly 30. This embodiment is adapted for setting the rear of conventional, eyelet type fasteners 284. The face portion 500 of nosepiece 490 comprises a dished-shaped recess 502 that is adapted to engage the flange 286 of the eyelet type fastener 284 and bend it backwards into the rear piece of material to clamp the piece of material between the bent flange and the distended front of the fastener, as shown in FIG. 13.

Each of the nosepieces 290, 390, and 490, as well as nosepieces 90 and 190, are mountable in tool housing 22 by threading the apertures 298, 398, or 498, respectively, over the mandrel assembly 30 and screwing the mounting portions into aperture 96 in the housing. Thus, all five embodiments of the nosepiece can be utilized in conjunction with the rear fastener setting assembly, one at a time, and, of course, if the operator of the tool wishes to change nosepieces, this can be done in a rapid manner.

Each of the nosepieces 90 and 190, which are operable to split and peel back the flange portion of fastener 84, set the rear of the fastener right up against the rear piece of material, the pieces of material being thus clamped firmly between the front upset portion of the fastener and the rear split portion thereof. The set is not caused by the actual engagement of the slit pieces of the rear of the fastener with the rear piece of material, but by the distending of the fastener barrel by the progressive slitting of the flange and then the barrel.

In the cases of the nosepieces 290 and 490, the bent back flange itself engages and clamps the rear piece of material, while in the case of nosepiece 390, the rear of the fastener barrel is distended by the nosepiece and clamps up against the material.

Each of the nosepieces 90, 190, 290, 390 and 490 is operable as described hereinabove to set fasteners without the use of resilient member 110. However, the biasing action of resilient member 110 precludes the possibility of the rear piece of material being frozen on the fastener barrel by the rear fastener setting assembly in a position spaced from the front piece of material.

In addition to biasing the pieces of material together on the fastener barrel, the resilient member 110 assures that the pieces of material are flush by compressing them together once the pieces of material are brought into engagement with the resilient member and each other. This happens when continued rearward movement of the mandrel assembly presses the rear piece of material into the resilient member. This compressing action performed by the resilient member is particularly useful in those instances when the pieces of material are bent, or when elastic material is being set.

The "spring" constant of the resilient member is selected such that the force exerted thereby plus the force required to set the rear of the fastener is less than the opposing force provided by the pneumatic-hydraulic assembly. This "spring" constant of the resilient member will thus vary in accordance with the size and material of the fastener being set.

These and all other such embodiments, variations, and modifications that incorporate the spirit of the invention and depend upon its underlying concept are, consequently, to be considered as within the scope of the claims appended herebelow, unless the claims by their language expressly state otherwise.

I claim:

1. Apparatus for setting blind fasteners having a front portion, a rear portion and an aperture therethrough, in a plurality of pieces of material, which comprises:

fastener setting means having an aperture therethrough and a portion adapted to engage and set a fastener, mandrel means mounted for reciprocal movement in said aperature in the fastener setting means, said mandrel means extending out from said aperture and being adaptable to receive a fastener thereon, the mandrel means including a front portion adaptable to set the front of the fastener when driven into engagement with it, means for driving the mandrel means rearwardly to first set the front of the fastener and then to drive the fastener thereon rearwardly until the rear portion of the fastener is driven into the fastener setting means to set the rear of the fastener, and means mounted on said fastener setting means for engaging the rearmost piece of material on the fastener and driving it forwardly on the fastener into engagement with the piece of material on the fastener in front thereof as the fastener is driven rearwardly by the mandrel means.

2. Apparatus according to claim 1, wherein said portion of the fastener setting means adapted to engage and set a fastener comprises means for slitting the rear of the fastener and bending the slit ends back toward the pieces of the material.

3. Apparatus according to claim 1, wherein the apparatus is adapted for setting blind fasteners having a flat flange provided at the rear end thereof perpendicular to a cylindrical body portion, and the fastener setting means includes a rounded recess provided therein for receiving the flat flange portion of the fastener and shaping it back toward the pieces of material as the fastener is driven thereagainst by the mandrel means, the deepest portion of said recess being located around the center thereof.

4. Apparatus according to claim 2, where the means for slitting the rear of the fastener and bending the slit ends back towards the pieces of material includes a shaped face portion having sharp ridges thereon for engaging said one end of the fastener and slitting it.

5. Apparatus according to claim 1, wherein the fastener setting means includes a frustopyramidal portion positioned with the smaller end thereof spaced from and adapted to engage the rear of the fastener, said frustopyramid having rounded edges.

6. Apparatus according to claim 1, wherein the mandrel means includes:

a headed mandrel mounted through the aperature in the fastener setting means with the head extending out therefrom and being of a cross-sectional area larger than that of the aperture in the fastener setting means, and the means for driving the mandrel means rearwardly includes means for grasping the shank of the mandrel from the other side of the aperture in the fastener setting means.

7. Apparatus according to claim 1, wherein the mandrel means includes:

an expandible mandrel assembly adapted to receive the fastener thereon by the insertion thereof through the aperture in the fastener, and means for expanding the cross-sectional area of a portion of the mandrel assembly adjacent the front of the fastener to set the same.

8. Apparatus for setting blind fasteners having a flange end, a barrel portion and an aperture therethrough in a plurality of pieces of material, which comprises:

a housing, a nosepiece mounted in the housing and having means thereon for setting the flange end of a fastener when the fastener is driven thereagainst, means for engaging and setting the barrel end of the fastener and driving it in a rectilinear path toward the nosepiece for the setting of the flange end, and means mounted concentrically with the nosepiece for engaging and biasing the material on the fastener together prior to the setting of the flange end of the fastener.

9. Apparatus for setting blind fasteners having a flange end, a barrel portion and an aperture therethrough in a plurality of pieces of material, which comprises:

a housing, a nosepiece mounted in the housing and having means thereon for setting the flange end of a fastener when the fastener is driven thereagainst, means for engaging and setting the barrel end of the fastener and driving it in a rectilinear path toward the nosepiece for the setting of the flange end, and an annular resilient member mounted to the housing, surrounding the nosepiece and extending toward the pieces of material on the fastener for biasing the pieces of material on the fastener together prior to the setting of the flange end of the fastener.

10. Apparatus for setting blind fasteners having a flange end, a barrel portion and an aperture therethrough in a plurality of pieces of material, which comprises:

a housing, a nosepiece mounted in the housing having an aperture therethrough and a front portion having sharp ridges thereon, an expandible mandrel assembly mounted for reciprocal movement in said housing, said mandrel assembly extending out from the aperture in the nosepiece and being adaptable to receive a fastener thereon, the mandrel assembly being sized such that the front of the assembly extends out of the front of the fastener when a fastener is mounted thereon, means for expanding the mandrel assembly to engage and set the front of the fastener, means for driving the mandrel assembly with the fastener engaged thereon rearwardly until the rear of fastener is driven into the front of the nosepiece, the sharp ridges on the nosepiece being operable to slit the rear of the fastener and peel back the segments thereof until the rear of the fastener is set against the pieces of material, and an annular resilient member mounted to the front of the housing, surrounding the nosepiece and extending toward the pieces of material mounted on the fastener, said annual resilient member being operable to engage the pieces of material and bias them together prior to the setting of the rear of the fastener.

11. Apparatus for setting blind fasteners having a flange end, a barrel portion and an aperture therethrough in a plurality of pieces of material, which comprises:

a housing, a nosepiece mounted in the housing having an aperature therethrough and a front portion having sharp ridges thereon, means for driving the mandrel rearwardly to set the front of the fastener by driving the enlarged head of the mandrel against it, and to drive the fastener thereon rearwardly until the rear of the fastener is driven into the front of the nosepiece, the sharp ridges on the nosepiece being operable to slit the rear of the fastener and peel back the segments thereof until the rear of the fastener is set against the pieces of material, and an annular resilient member mounted to the front of the housing, surrounding the nosepiece and extending toward the pieces of material mounted on the fastener, said annual resilient member being operable to engage the pieces of material and bias them together prior to the setting of the rear of the fastener.

* * * * *